US011719171B2

(12) United States Patent
Sutoh et al.

(10) Patent No.: US 11,719,171 B2
(45) Date of Patent: Aug. 8, 2023

(54) ELECTRONIC CONTROL METHOD FOR THROTTLE AND ELECTRONIC CONTROL THROTTLE DEVICE

(71) Applicant: NIKKI CO., LTD., Kanagawa-ken (JP)

(72) Inventors: Yuuki Sutoh, Kanagawa-ken (JP); Ryuichi Oguro, Kanagawa-ken (JP); Norichika Kojima, Kanagawa-ken (JP)

(73) Assignee: Nikki Co., Ltd.

( * ) Notice: Subject to any disclaimer, the term of this patent is extended or adjusted under 35 U.S.C. 154(b) by 0 days.

(21) Appl. No.: 17/702,375

(22) Filed: Mar. 23, 2022

(65) Prior Publication Data

US 2022/0307429 A1 Sep. 29, 2022

(30) Foreign Application Priority Data

Mar. 24, 2021 (JP) ..... JP2021-050322

(51) Int. Cl.
*F02D 11/10* (2006.01)
*F02D 41/14* (2006.01)

(52) U.S. Cl.
CPC ..... *F02D 11/105* (2013.01); *F02D 41/1497* (2013.01); *F02D 2200/0404* (2013.01); *F02D 2200/101* (2013.01); *F02D 2200/1004* (2013.01)

(58) Field of Classification Search
CPC ..... F02D 11/10; F02D 11/105; F02D 41/14; F02D 41/1497
See application file for complete search history.

(56) References Cited

U.S. PATENT DOCUMENTS 6,820,589 B2 11/2004 Okubo
8,041,487 B2 10/2011 Worthing
(Continued)

FOREIGN PATENT DOCUMENTS

JP H05-240073 A 9/1993
JP 2008-038872 A 2/2008
JP 2021-050322 A 4/2021

OTHER PUBLICATIONS

English abstract for JP-2021-050322.
(Continued)

*Primary Examiner* — John Kwon
*Assistant Examiner* — Johnny H Hoang
(74) *Attorney, Agent, or Firm* — Fishman Stewart PLLC

(57) ABSTRACT

An electronic control method for a throttle by an electronic control throttle device that controls the throttle while an electronic control unit generates a control signal based on an input data signal. The method may include calculating an engine rotation speed deviation from a difference between an engine rotation speed and an input engine rotation speed command, calculating an engine rotational acceleration based on the engine rotation speed, obtaining a proportional torque from a product of the engine rotation speed deviation and a predetermined coefficient, obtaining an integral torque by integrating a value obtained by subtracting a product of the engine rotational acceleration and the predetermined coefficient from the product of the engine rotation speed deviation and the predetermined coefficient, and generating a control signal for the throttle by using a sum of the proportional torque and the integral torque as a value of a torque command.

5 Claims, 3 Drawing Sheets

(56) References Cited

U.S. PATENT DOCUMENTS

| | | | | |
|---|---|---|---|---|
| 2009/0076693 | A1* | 3/2009 | Kumazaki | B60W 10/10 701/55 |
| 2014/0052320 | A1* | 2/2014 | Kamono | B60W 20/11 180/65.265 |
| 2015/0059693 | A1 | 3/2015 | Goho | |
| 2015/0300423 | A1* | 10/2015 | Takeda | B60K 6/442 180/65.23 |
| 2016/0373033 | A1* | 12/2016 | Suzuki | H02P 27/08 |
| 2016/0373046 | A1* | 12/2016 | Suzuki | H02P 7/29 |

OTHER PUBLICATIONS

English abstract for JP-2008-038872.
English abstract for JP-H05-240073.
Anonymous: "Torque—Wikipedia", Apr. 20, 2022 (Apr. 20, 2022), XP055969244, Retrieved from the Internet: URL: https://en.wikipedia.org/w/index.php?title=Torque&oldid=1083763903 [retrieved on Oct. 10, 2022] * pp. 1-4 * [retrieved on Dec. 16, 2022] 20.
Extended European Search Report dated Oct. 20, 2022 for copending European Patent App. No. EP 22170080.0.

* cited by examiner

ELECTRONIC CONTROL METHOD FOR THROTTLE AND ELECTRONIC CONTROL THROTTLE DEVICE

CROSS REFERENCE TO RELATED APPLICATIONS

This application claims priority to Japanese Patent Application No. JP 2021-050322, filed on Mar. 24, 2021, the contents of which is hereby incorporated by reference in its entirety.

TECHNICAL FIELD

The present invention relates to a control method for opening and closing a throttle installed in an intake system of an engine by an electronic control system and an electronic control throttle device for performing the same, and more particularly, to an electronic control method for a throttle and an electronic control throttle device for making a decrease in a rotation speed of the engine and an engine stall less likely to occur when a load is applied.

BACKGROUND

In recent years, in order to perform engine control with high accuracy for the purpose of improving fuel consumption and traveling performance of a vehicle, as described in, for example, JP H05-240073 A, instead of mechanically opening and closing a throttle installed in an engine intake system by an accelerator operation of a driver, an electronic control throttle device that opens and closes the throttle by an operation of an electronic control unit has been widely used.

By the way, in such an electronic control throttle device, when a load amount in an operating state of an engine suddenly changes or the vehicle travels without an accelerator operation, there is a case where control by an electronic control unit does not follow or a difference occurs between a predicted value and an actual value in the control. In particular, there is a problem that a rotation speed of the engine suddenly drops and an engine stall easily occurs.

On the other hand, the applicant and the inventors of the present application have previously invented a control method in which a throttle opening is controlled so as not to excessively decrease an engine rotation speed while monitoring the engine rotation speed with an electronic control unit, a difference between the detected engine rotation speed and a target rotation speed (engine rotation speed command) is calculated to obtain a deviation of the rotation speed, and an actuator of the throttle is driven so as to realize a throttle operation set in advance as an appropriate value according to an amount of the deviation, and have proposed the control method in JP 2008-038872 A.

As described above, in a case where the electronic control of the throttle is performed by obtaining the deviation between the engine rotation speed command and the actual engine rotation speed, currently, it is general to execute the control method according to the procedure illustrated in FIG. 5 by the electronic control throttle device 1B having the configuration illustrated in FIG. 4.

That is, a rotation speed calculation unit 10*a* calculates the engine rotation speed from the pulse signal by a crank pulse sensor, a rotation speed deviation calculation unit 10*b* subtracts the engine rotation speed from the engine rotation speed command to calculate the engine rotation speed deviation, a proportional torque calculation unit 10*c* calculates the proportional torque from the product of the engine rotation speed deviation and the coefficient to obtain the proportional torque, an integral torque calculation unit 10*e* integrates the product of the engine rotation speed deviation and the coefficient to obtain the integral torque, and the sum of the value of the proportional torque and the value of the integral torque is used as the torque command to request the engine.

However, in such a conventional electronic control method for a throttle, when the product of the engine rotation speed deviation and the coefficient is integrated, the integral torque constantly goes in the decreasing direction when the engine rotation speed is higher than the engine rotation speed command and the engine rotation speed deviation is negative.

Therefore, as illustrated in a graph of FIG. 6, when the engine rotation speed is decelerated while applying a load in a situation where the engine rotation speed is larger than the engine rotation speed command, there is a problem that the engine rotation speed undershoots with respect to the engine rotation speed command or the engine stall occurs.

SUMMARY

The present invention is intended to solve the above problems, and an object of the present invention is to make electronic control of a throttle less likely to cause a decrease in engine rotation speed and an engine stall when a load is applied.

There is provided an electronic control method for a throttle by an electronic control throttle device that performs opening and closing control of the throttle while an electronic control unit generates a control signal based on an input data signal, the method, by the electronic control unit, including: calculating an engine rotation speed deviation from a difference between a calculated or input engine rotation speed and an input engine rotation speed command and calculating an engine rotational acceleration based on the engine rotation speed; obtaining a proportional torque from a product of the engine rotation speed deviation and a predetermined coefficient and obtaining an integral torque by integrating a value obtained by subtracting a product of the engine rotational acceleration and the predetermined coefficient from the product of the engine rotation speed deviation and the predetermined coefficient; and generating a control signal for the throttle by using a sum of the proportional torque and the integral torque as a value of a torque command.

As described above, regarding the integral torque for calculating the torque command for the throttle, in the conventional example, the product of the engine rotation speed deviation and the coefficient is simply integrated to obtain the integral torque. On the other hand, in the present invention, by adopting a method of integrating a value obtained by subtracting the product of the engine rotational acceleration and the coefficient from the product of the engine rotation speed deviation and the coefficient to obtain the integral torque, integral torque operates so as to accelerate when the integral value is positive and decelerate when the integral value is negative. Therefore, when the engine rotation speed is higher than the engine rotation speed command, the integral torque is not excessively reduced. Therefore, a decrease in the engine rotation speed or an engine stall when a load is applied is unlikely to occur.

In addition, in the control method of the electronic control throttle device according to the present invention, when the coefficient for obtaining the product with the engine rotational acceleration when the integral torque is calculated is a time constant when the engine rotation speed converges to the engine rotation speed command, an action of preventing undershoot and engine stall with respect to the engine rotation speed command becomes reliable.

Further, in an electronic control throttle device including: a throttle to which an actuator is attached; and an electronic control unit, the electronic control unit performing opening and closing control of the throttle via the actuator while generating a control signal based on an input data signal, the electronic control unit includes: a rotation speed deviation calculation unit that calculates an engine rotation speed deviation from a difference between an engine rotation speed and an engine rotation speed command; a rotational acceleration calculation unit that calculates an engine rotational acceleration based on the engine rotation speed; a proportional torque calculation unit that obtains a proportional torque from a product of the engine rotation speed deviation and a predetermined coefficient; and an integral torque calculation unit that obtains an integral torque by integrating a value obtained by subtracting a product of the engine rotational acceleration and the predetermined coefficient from the product of the engine rotation speed deviation and the predetermined coefficient, and the electronic control throttle device executes the electronic control method for the throttle described above, the operation and effect of the control method according to the present invention can be automatically realized.

According to the present invention in which the engine rotational acceleration is used for the calculation of the integral torque for obtaining the torque command, it is possible to make the engine rotation speed decrease and the engine stall hardly occur when a load is applied.

DETAILED DESCRIPTION

Hereinafter, embodiments of the present invention will be described with reference to the drawings.

Figure 1:
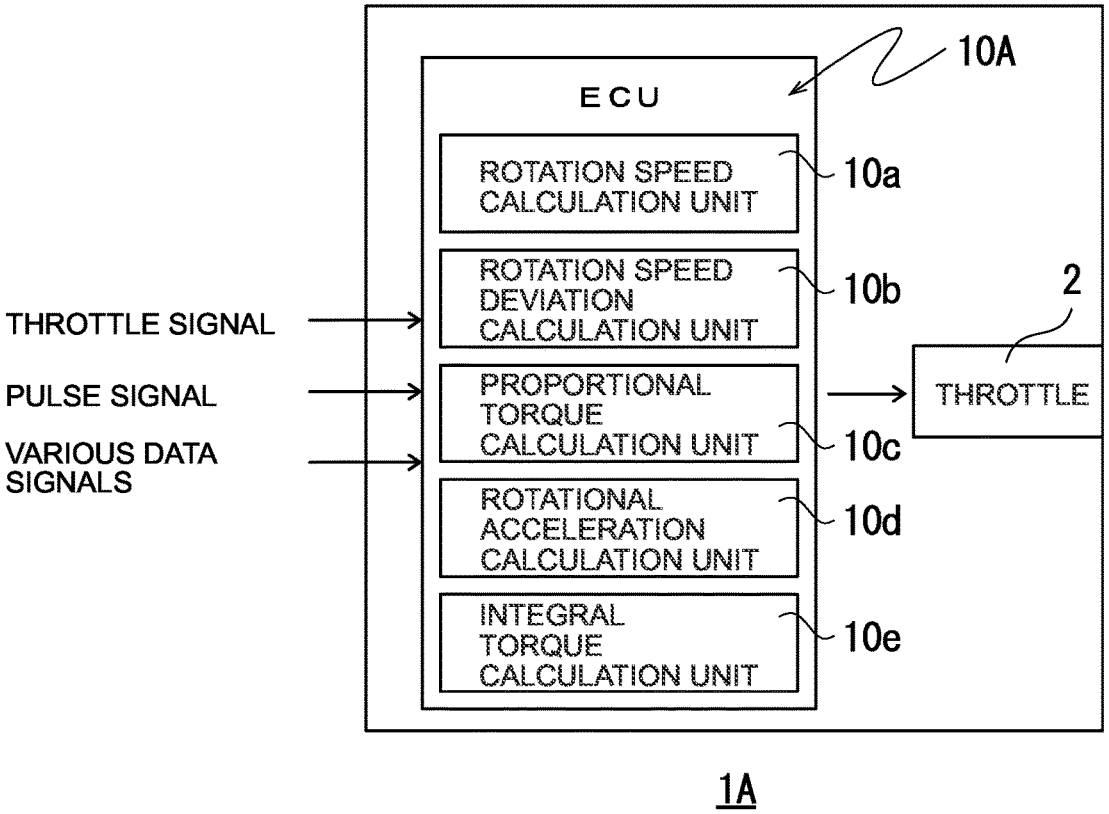
FIG. 1 is a simplified configuration diagram of an electronic control throttle device according to a preferred embodiment of the present invention.

FIG. 1 schematically illustrates a functional configuration of an electronic control throttle device 1A as a preferred embodiment for executing an electronic control method for a throttle according to the present invention.

The electronic control throttle device 1A includes a throttle 2 to which an actuator (not illustrated) is attached, and an electronic control unit 10A that performs opening and closing control of the throttle 2. The electronic control unit 10A automatically performs opening and closing control of the throttle 2 while generating a control signal by a predetermined calculation method based on various data signals input thereto.

In addition, the electronic control unit 10A includes, as unit functionally configured by software stored in a storage unit (not illustrated), a rotation speed calculation unit 10*a* that calculates an engine rotation speed, a rotation speed deviation calculation unit 10*b* that calculates an engine rotation speed deviation, a rotational acceleration calculation unit 10*d* that calculates an engine rotational acceleration, a proportional torque calculation unit 10*c* that obtains a proportional torque, and an integral torque calculation unit 10*e* that obtains an integral torque. Note that, in a case where the data signal of the engine rotation speed, not the pulse signal, is input to the electronic control unit 10A, the above-described rotation speed calculation unit 10*a* is unnecessary.

Figure 2:
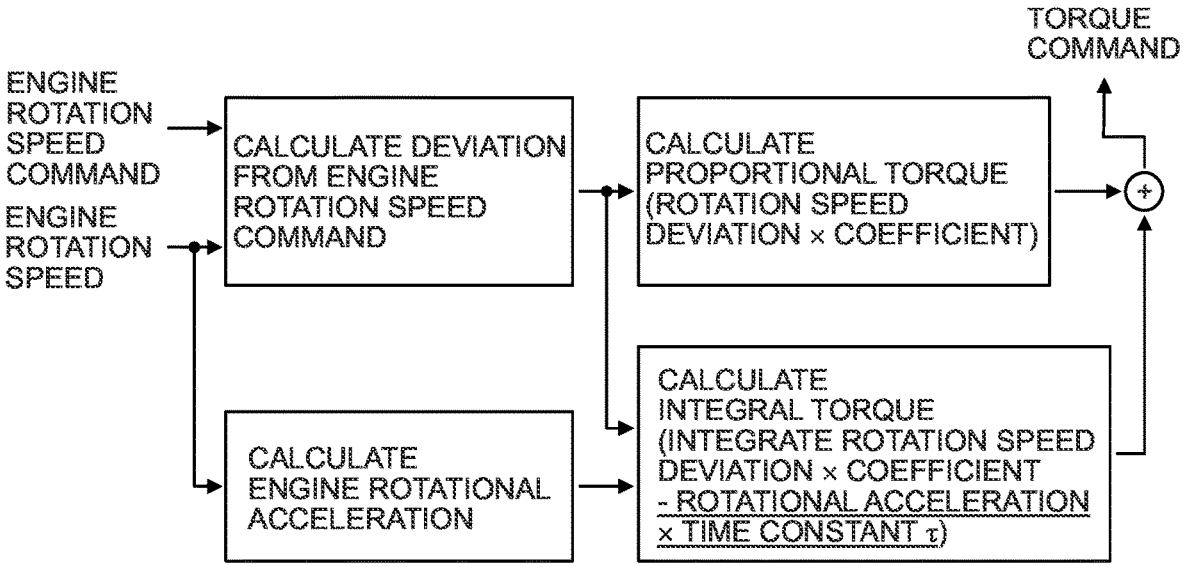
FIG. 2 is a functional block diagram illustrating control contents by an electronic control throttle device according to the embodiment illustrated in FIG. 1.

Next, control contents executed by the electronic control unit 10A will be described in detail with reference to the configuration diagram of FIG. 1 and the functional block diagram of FIG. 2.

First, the rotation speed calculation unit 10*a* calculates the engine rotation speed from a cycle of a pulse signal input from a crank pulse sensor (not illustrated), the rotation speed deviation calculation unit 10*b* calculates the engine rotation speed deviation from a difference between the engine rotation speed and an issued engine rotation speed command (target rotation speed), and the rotational acceleration calculation unit 10*d* calculates the engine rotational acceleration based on the engine rotation speed.

Then, the proportional torque calculation unit 10*c* calculates a product of the engine rotation speed deviation and a predetermined coefficient to obtain a proportional torque, and the integral torque calculation unit 10*e* performs calculation of integrating a value obtained by subtracting the product of the engine rotational acceleration and the predetermined coefficient from the product of the engine rotation speed deviation and the predetermined coefficient to obtain an integral torque, and generate a control signal for the throttle 2 using a sum of the proportional torque and the integral torque as a value of a torque command.

In this case, the calculation performed by the integral torque calculation unit 10*e* is based on the following expression 1.

$$\mathrm{Torq}_i = K_i \int \{(\omega_{ref} - \omega) - \tau\omega'\} dt \qquad \text{[Formula 1]}$$

Figure 4:
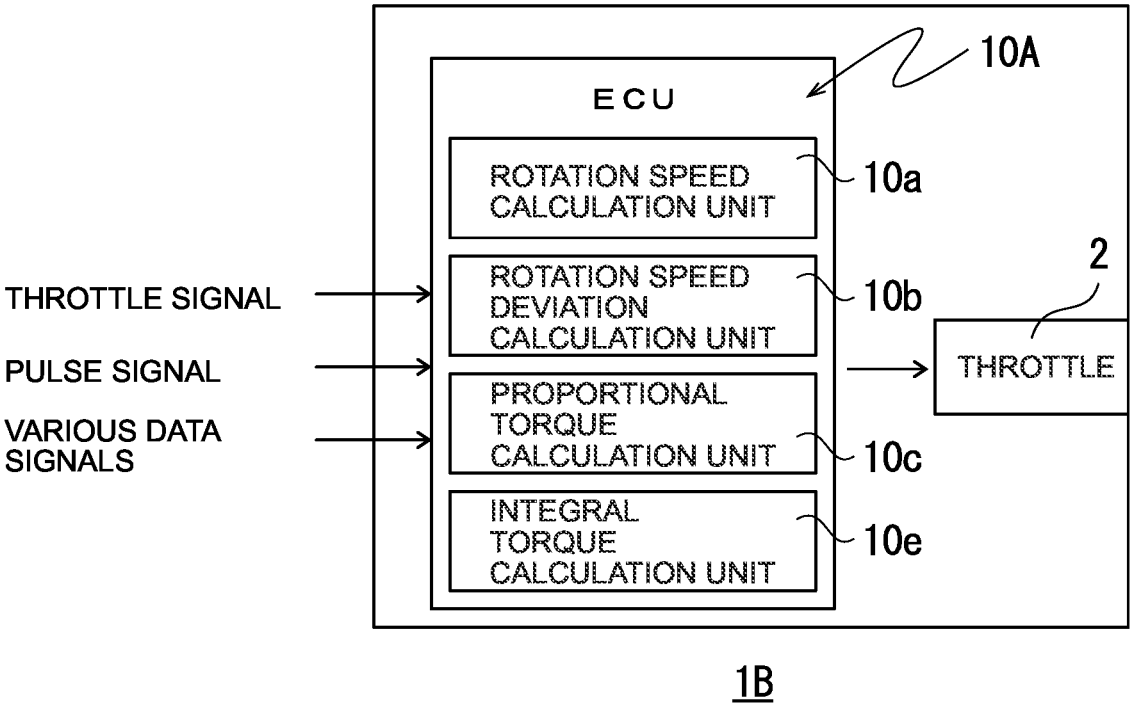
FIG.4 Related Art
FIG. 4 is a simplified configuration diagram of an electronic control throttle device according to a conventional example.
Figure 5:
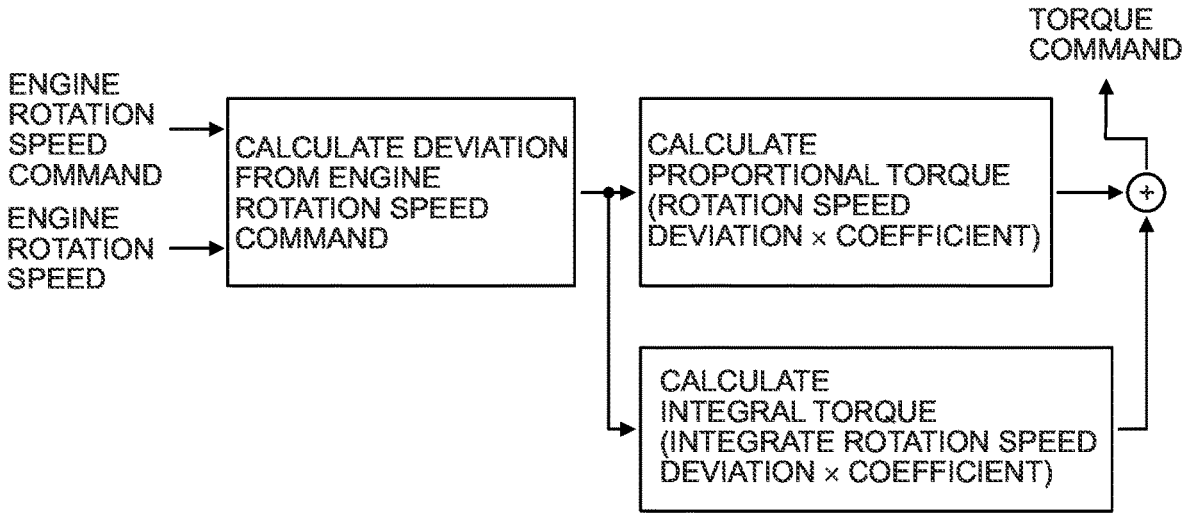
FIG.5 Related Art
FIG. 5 is a functional block diagram showing control contents by the electronic control throttle device of FIG. 4.

In the expression 1, $\mathrm{Torq}_1$ is an integral torque, $K_i$ is an integral torque gain, $\omega_{ref}$ is an engine rotation speed command, $\omega$ is an engine rotation speed, $\tau$ is an arbitrarily settable coefficient, and $\omega'$ is an engine rotational acceleration. However, in the present embodiment, a term $-\tau\omega'$ is added to the integral term performed by the conventional integral torque calculation unit 10*f* in FIG. 4, and the engine rotational acceleration is used for the calculation for obtaining the integral torque.

Figure 3:
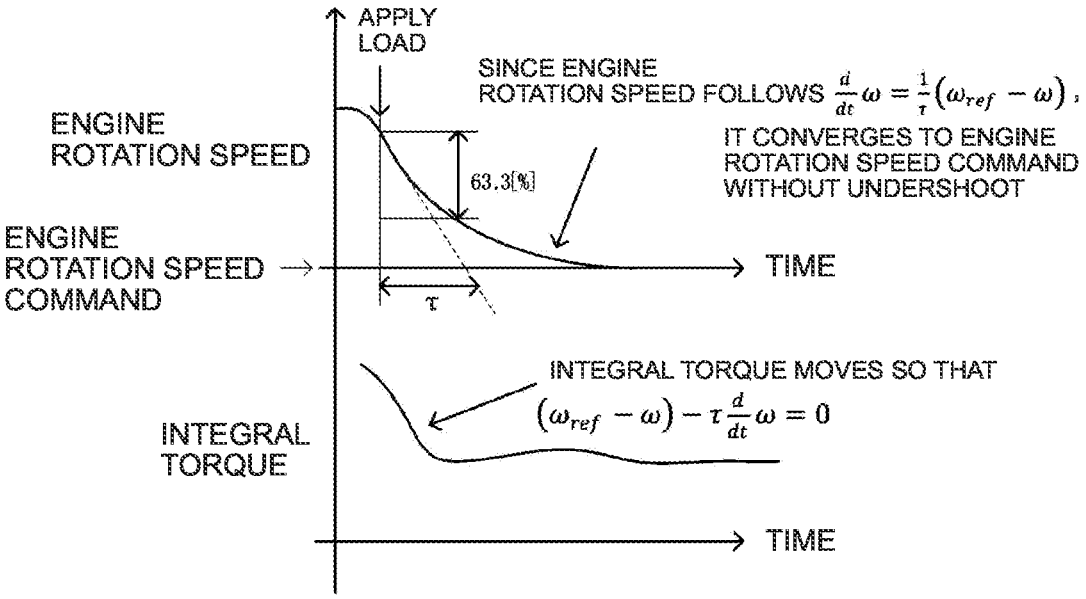
FIG. 3 is a graph illustrating a transition of an engine rotation speed and an integral torque in a control example by the electronic control throttle device according to the embodiment illustrated in FIG. 1.

Hereinafter, the operation of the electronic control throttle device 1A of the present embodiment will be described with reference to the graph of FIG. 3.

This graph illustrates a change in the integral torque when converging to the engine rotation speed command while applying a load when the actual engine rotation speed is higher than the engine rotation speed command in the electronic control throttle device 1A described above. The integral torque in the present embodiment operates so as to accelerate when $(\omega_{ref} - \omega) - \tau\omega'$ in the expression 1 is positive and decelerate when $(\omega_{ref}-\omega)-\tau\omega'$ in the expression 1 is negative. Therefore, the engine rotation speed in this case operates so as to follow $(\omega_{ref}-\omega)-\tau\omega'=0$, that is, the following expression 2.

[Formula 2]

$$\frac{d}{dt}\omega = \frac{1}{\tau}(\omega_{ref} - \omega) \tag{2}$$

Figure 6:
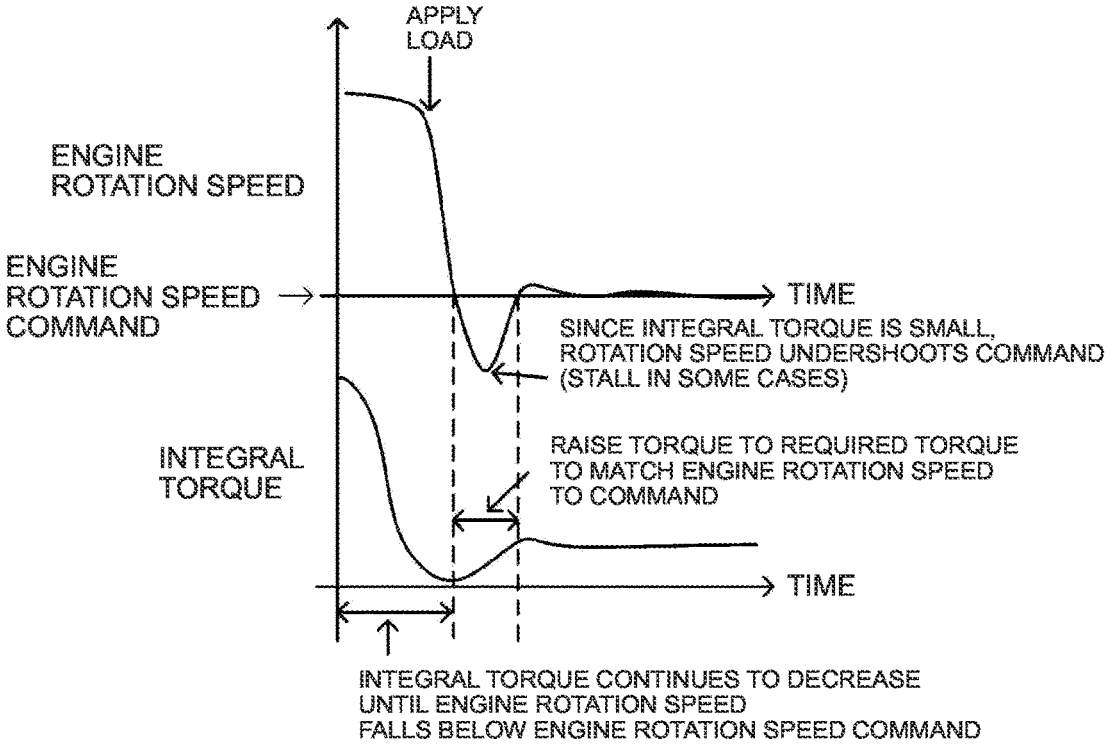
FIG.6 Related Art
FIG. 6 is a graph illustrating a transition of an engine rotation speed and an integral torque in a control example by the electronic control throttle device of FIG. 4.

From the expression 2, $\tau$ set here is a time constant when the engine rotation speed converges to the engine rotation speed command. Therefore, even when the engine rotation speed is higher than the engine rotation speed command as in the integral torque in the conventional control illustrated in FIG. 6, the integral torque is not excessively reduced, so that undershoot of the engine rotation speed is less likely to occur, and occurrence of engine stall can be prevented.

As described above, according to the present invention, in the electronic control of the throttle, it is possible to make the decrease in the rotation speed of the engine and the engine stall less likely to occur when a load is applied.

What is claimed is:

1. An electronic throttle control method by an electronic control throttle device that performs opening and closing control of the throttle while an electronic control unit generates a control signal based on an input data signal, the method, by the electronic control unit, comprising:

calculating an engine rotation speed deviation from a difference between an engine rotation speed and an input engine rotation speed command;

calculating an engine rotational acceleration based on the engine rotation speed;

obtaining a proportional torque from a product of the engine rotation speed deviation and a predetermined coefficient;

obtaining an integral torque by integrating a value obtained by subtracting a product of the engine rotational acceleration and the predetermined coefficient from the product of the engine rotation speed deviation and the predetermined coefficient; and generating the control signal for the throttle by using a sum of the proportional torque and the integral torque as a value of a torque command.

2. The electronic control method for the throttle according to claim 1, wherein the predetermined coefficient for obtaining the product with the engine rotational acceleration when obtaining the integral torque is a time constant when the engine rotation speed converges to the input engine rotation speed command.

3. An electronic control throttle device, comprising:

a throttle to which an actuator is attached; and an electronic control unit configured for opening and closing control of the throttle via the actuator and generating a control signal based on an input data signal;

wherein the electronic control unit includes:

a rotation speed deviation calculation unit configured to calculate an engine rotation speed deviation from a difference between an engine rotation speed and an engine rotation speed command;

a rotational acceleration calculation unit configured to calculate an engine rotational acceleration based on the engine rotation speed;

a proportional torque calculation unit configured to obtain a proportional torque from a product of the engine rotation speed deviation and a predetermined coefficient; and an integral torque calculation unit configured to obtain an integral torque by integrating a value obtained by subtracting a product of the engine rotational acceleration and the predetermined coefficient from the product of the engine rotation speed deviation and the predetermined coefficient; and wherein the electronic control unit is configured to generate the control signal for the throttle by using a sum of the proportional torque and the integral torque as a value of a torque command.

4. The electronic control throttle device according to claim 3, wherein the predetermined coefficient for obtaining the product with the engine rotational acceleration when obtaining the integral torque is a time constant when the engine rotation speed converges to the engine rotation speed command.

5. A method of controlling a throttle of an electronic control throttle device, comprising operating an electronic control unit of the electronic control throttle device to generate a control signal based on an input data signal, wherein operating the electronic control unit includes:

calculating an engine rotation speed deviation from a difference between an engine rotation speed and an input engine rotation speed command;

calculating an engine rotational acceleration based on the engine rotation speed;

obtaining a proportional torque from a product of the engine rotation speed deviation and a predetermined coefficient;

obtaining an integral torque by integrating a value obtained by subtracting a product of the engine rotational acceleration and the predetermined coefficient from the product of the engine rotation speed deviation and the predetermined coefficient; and generating the control signal for the throttle by using a sum of the proportional torque and the integral torque as a value of a torque command.

* * * * *